US010562725B2

(12) United States Patent
Buffa et al.

(10) Patent No.: US 10,562,725 B2
(45) Date of Patent: Feb. 18, 2020

(54) DEVICE FOR REWINDING AND FORMING A PAPER ROLL AND RELATED METHOD

(71) Applicant: GAMBINI, S.p.A., Milan (IT)

(72) Inventors: Giovanni Buffa, Ponte Buggianese (IT); Fabio Picchi, Lammari (IT)

(73) Assignee: GAMBINI S.P.A., Milan (IT)

( * ) Notice: Subject to any disclaimer, the term of this patent is extended or adjusted under 35 U.S.C. 154(b) by 303 days.

(21) Appl. No.: 15/673,786

(22) Filed: Aug. 10, 2017

(65) Prior Publication Data

US 2018/0072526 A1 Mar. 15, 2018

(30) Foreign Application Priority Data

Sep. 9, 2016 (IT) ..... 102016000091411

(51) Int. Cl.
*B65H 18/16* (2006.01)
*B65H 19/26* (2006.01)
*B65H 19/22* (2006.01)

(52) U.S. Cl.
CPC ..... *B65H 19/267* (2013.01); *B65H 18/16* (2013.01); *B65H 19/2269* (2013.01); *B65H 2301/41812* (2013.01)

(58) Field of Classification Search
CPC .. B65H 19/267; B65H 19/2269; B65H 18/16; B65H 2301/41812
See application file for complete search history.

(56) References Cited

U.S. PATENT DOCUMENTS 5,639,046 A * 6/1997 Biagiotti ..... B65H 18/28 242/541.2
6,648,266 B1 * 11/2003 Biagiotti ..... B65H 18/14 242/521
6,877,689 B2 * 4/2005 Butterworth ..... B65H 19/2269 242/533.1
7,942,363 B2 * 5/2011 Gelli ..... B65H 18/26 242/532.2
8,267,344 B2 * 9/2012 Maddaleni ..... B65H 19/2269 242/532.1

(Continued)

FOREIGN PATENT DOCUMENTS

EP 0611723 8/1994
EP 1205414 5/2002

(Continued)

*Primary Examiner* — Sang K Kim
(74) *Attorney, Agent, or Firm* — King & Shickli, PLLC

(57) ABSTRACT

A device for rewinding and forming a paper roll in a rewinding machine comprising three rollers with parallel axes and perpendicular to the paper feeding direction, wherein two lower and upper winding rollers supported on a frame cooperate with a third swivel roller in pressure on a roll being formed, the paper being wound provided with a series of transverse piercing and weakening lines spaced apart according to regular intervals along their longitudinal development passing on the upper winding roller and finished roll exiting from an output opening defined between the lower roller and the third roller, the cores for the rolls fed one after the other by a conveyor, wherein mechanical tearing means are placed in the upper roller along its development facing towards the side of the paper facing towards the upper roller to positively act directly at a piercing line and cause the tearing of the paper.

10 Claims, 6 Drawing Sheets

(56) References Cited

U.S. PATENT DOCUMENTS

| | | | | |
|---|---|---|---|---|
| 2005/0087647 | A1 | 4/2005 | Butterworth et al. | |
| 2006/0169733 | A1* | 8/2006 | Perini ..... | B65H 19/267<br>225/93 |

FOREIGN PATENT DOCUMENTS

| | | |
|---|---|---|
| EP | 1262434 | 12/2002 |
| EP | 2253568 | 11/2010 |
| EP | 2422943 | 2/2012 |

* cited by examiner

DEVICE FOR REWINDING AND FORMING A PAPER ROLL AND RELATED METHOD

This application claims the benefit of Italian Patent Application Ser. No. 102016000091411, filed Sep. 9, 2016, the disclosure of which is incorporated herein by reference.

TECHNICAL FIELD

The present invention relates to a device for rewinding and forming a paper roll and to a related method.

BACKGROUND

Peripheral rewinding machines are provided with three rollers with axes parallel to each other and perpendicular to the paper feeding direction, the paper being provided with a series of transverse piercing and weakening lines spaced apart according to regular intervals along the longitudinal development thereof. Two winding rollers, upper and lower, are supported on the frame and cooperate in winding with a third swinging roller, or press, which is kept under pressure on a roll being formed, the so-called log.

At the end of the winding of a log, in the so-called exchange step, the continuity of the paper being wound, partially returned on the upper roller, must be interrupted to unload the finished roll through an output opening defined between the lower roller and the third roller and start a new winding on a new core fed, provided with a longitudinal line of glue, within a channel formed between the upper roller and underlying curved elements, called cradles.

According to a first type of known rewinding machines, such as for example the one shown in EP 1 262 434 A2, in the exchange step the paper is interrupted by the action of a stopping element, or pad, which intervenes against the upper winding roller to press the paper against it, in an upstream position with respect to the new core inserted into the cradles. The stop of the paper against the upper roller results in a downstream tensioning thereof and the consequent tearing along a piercing, but also the formation of wrinkles upstream.

Starting a new winding on a core provided with glue should preferably begin in a point of the initial edge following that with wrinkles. A so-called tail is thus created, i.e. a portion of paper between the glue and the initial end of the paper, which is a scrap, not being useful in contributing to the length of the roll. The tail can reach 100-150 mm in length in the worst cases, equal to 1-1.5 tears, where tear means the distance between two successive piercings.

The quality standards that have imposed on the market, however, require the presence of a tail as short as possible, as it is considered an indicator of the product quality, both because it involves less scrap and because the presence of a short tail facilitates a more balanced winding start, thus creating less asymmetry in the roll.

The reduction of wrinkles has been achieved in rewinding machines by changing the intervention position of the stopping element against the upper winding roller. Trying to change the principle of intervention of the mechanical means on the paper, through the provision of mechanical tearing means placed between the paper being wound and the upper roller and acting in a direction oriented from the upper roller outwards, an attempt has been made to totally eliminate the wrinkle formation phenomenon. EP 2 422 943 A1 for example shows a plurality of arms arranged within transverse grooves of the upper winding roller and provided with a pointed end element adapted to protrude with respect to the shell of upper roller to intervene during the exchange step at a piercing of the paper to break the same, acting on the surface of the upper roll outwards, and to return to a retracted rest position during the winding.

However, this machine has some drawbacks that don't make it actually competitive compared to the rewinding machine provided with stopping element. In fact, the presence of a large number of parallel transverse grooves in the upper roller causes permanent marks on the first paper windings, considered by the market a sign of low product quality. Moreover, since the protuberances have to tear the paper during the exchange step along a piercing precisely facing them, the final length of the roll produced can only take certain values closely tied to the length of the piercings and to the development of the upper roller.

SUMMARY

The aim of the present invention is to provide a device for rewinding and forming a paper roll and a related method that allow reducing the tail to about 30-40 mm.

Another aim of the present invention is to provide a device for rewinding and forming a paper roll and a related method to eliminate the formation of wrinkles at the tail.

Another aim of the present invention is to provide a device for rewinding and forming a paper roll and a related method that allows the production of a flexible product, namely having a length as desired, only tied to the length of the piercings but not to the development of the upper roller.

Another aim of the present invention is to provide a device for rewinding and forming a paper roll and a relative method that are particularly simple and functional, with limited costs.

These aims according to the present invention are achieved by a device for rewinding and forming a paper roll and a relative method particularly simple and functional, as set out in the independent claims.

Further characteristics are disclosed in the dependent claims.

BRIEF DESCRIPTION OF THE DRAWING FIGURES

The characteristics and the advantages of a paper roll and a related method according to the present invention will become better apparent from the following exemplary and non-limiting description, made with reference to the accompanying drawings, in which.

Figure 1:
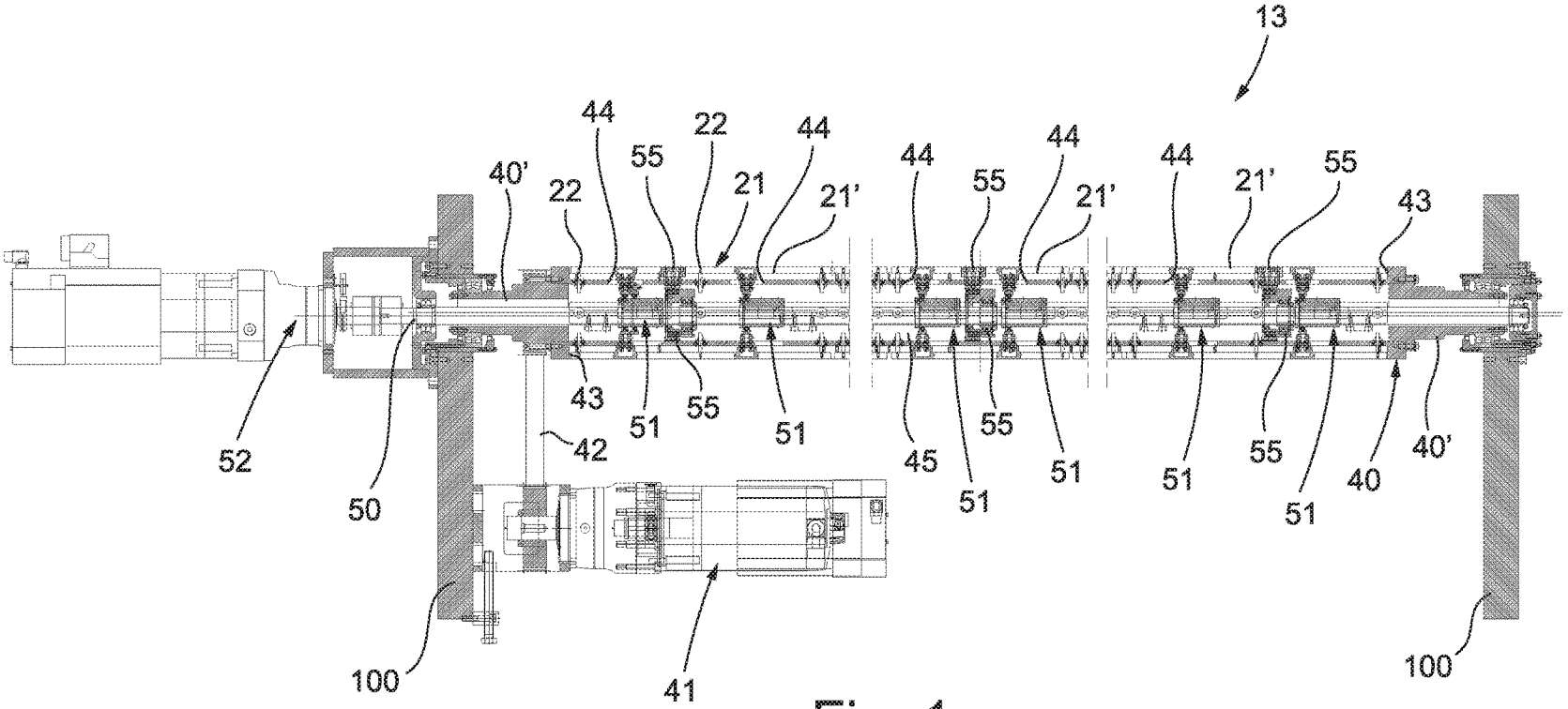
FIG. 1 is a lateral sectional view of an upper winding roller of a device for rewinding and forming a paper roll according to the invention.
Figure 3:
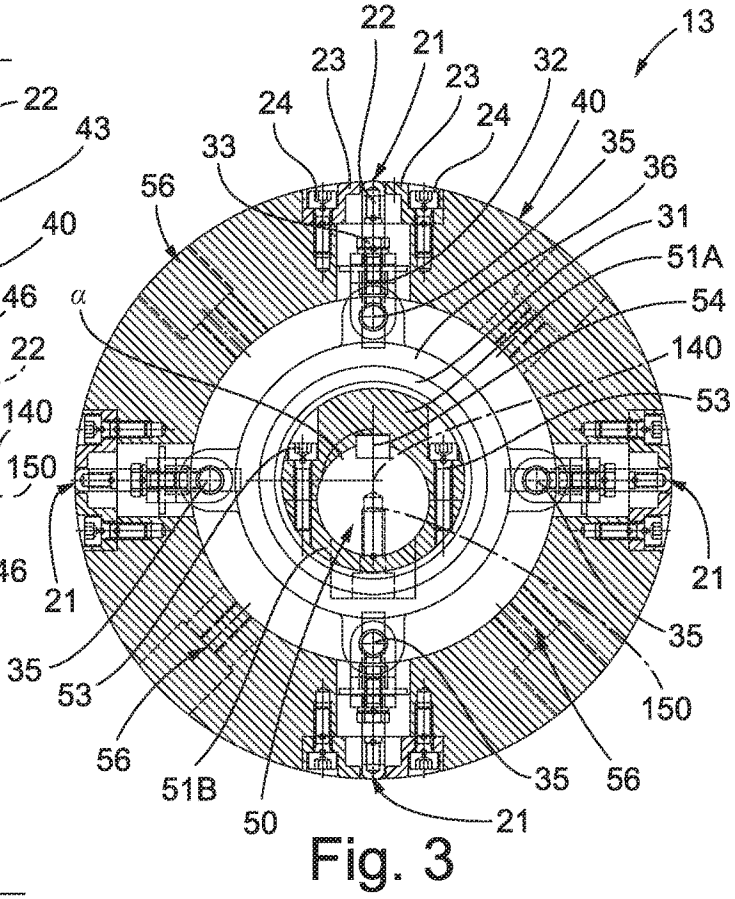
FIG. 3 is a schematic cross sectional view of the upper winding roller of FIG. 2.
Figure 2:
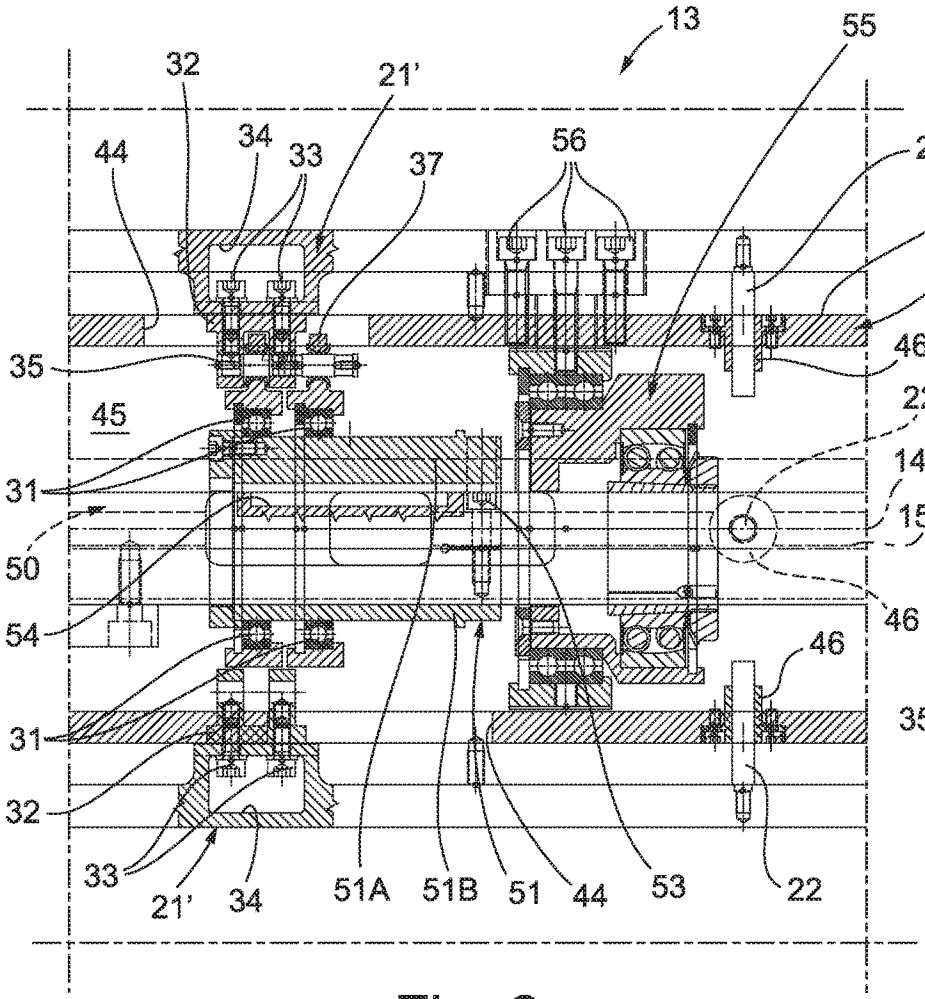
FIG. 2 is an enlarged detail view of the roll of FIG. 1 in section along multiple different planes for illustrative purposes.
Figure 4A:
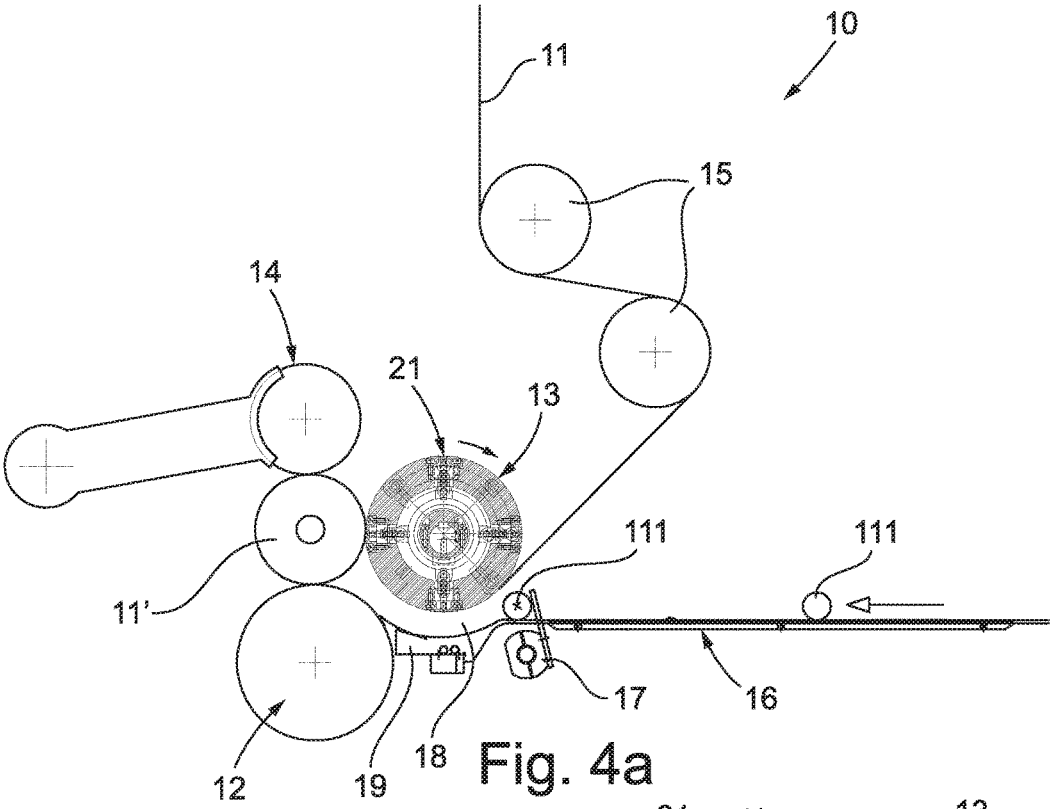
Figure 4B:
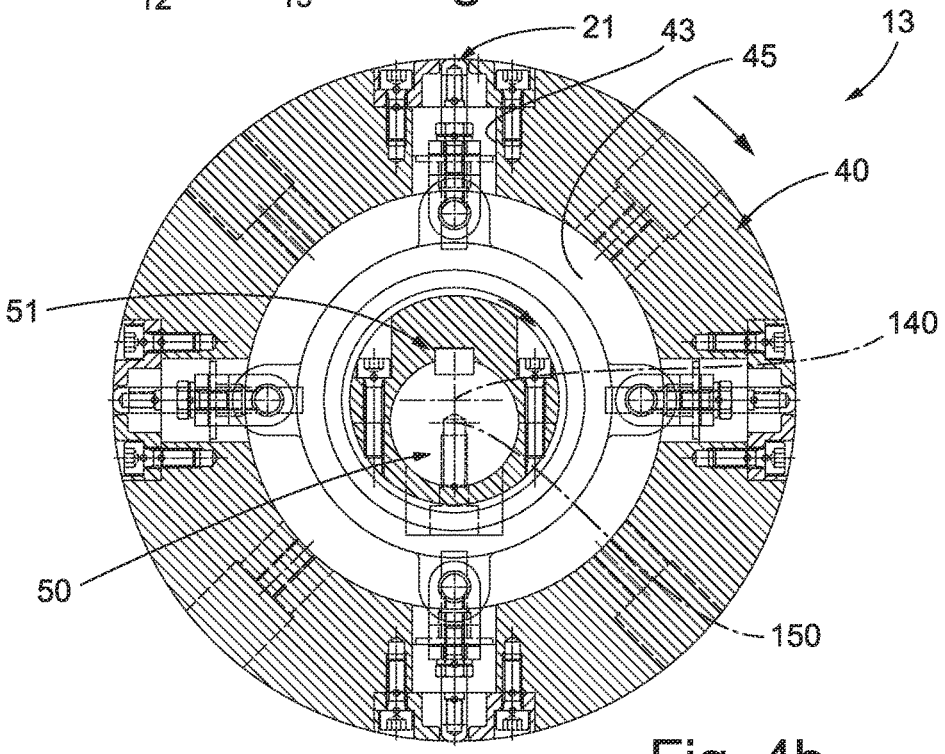
Figure 5A:
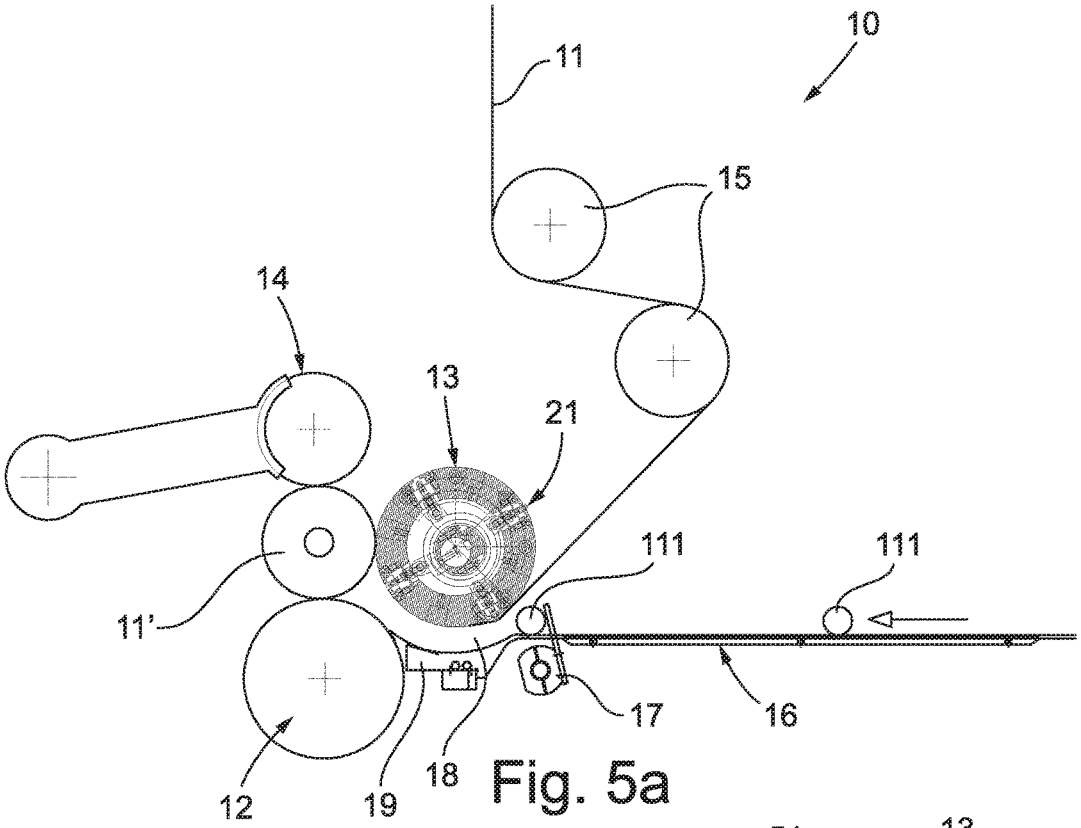
Figure 5B:
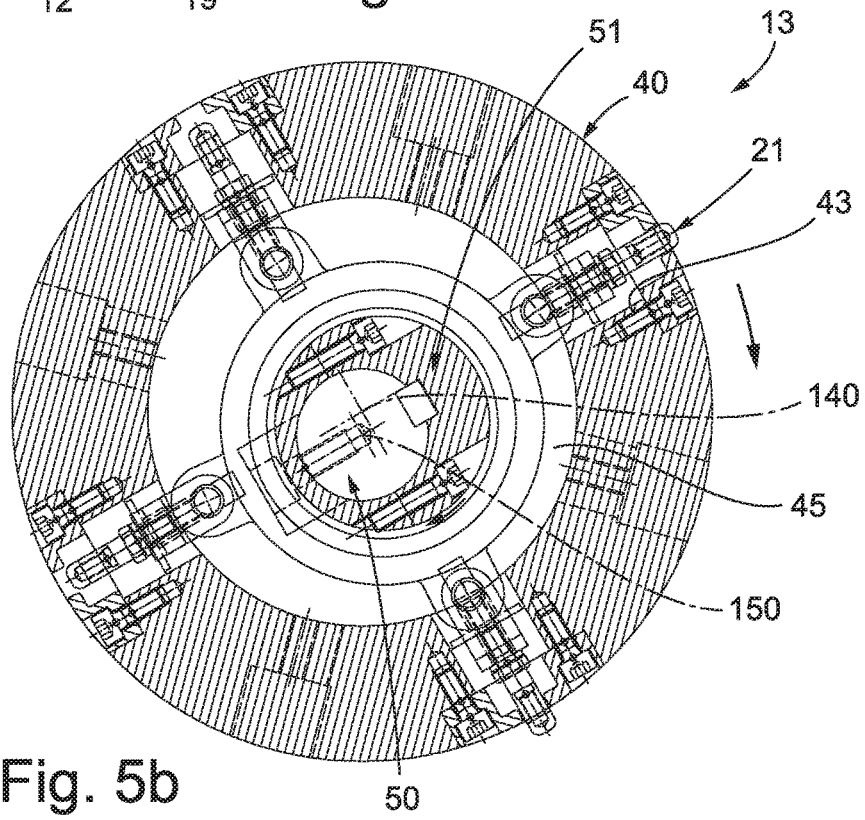
Figure 6A:
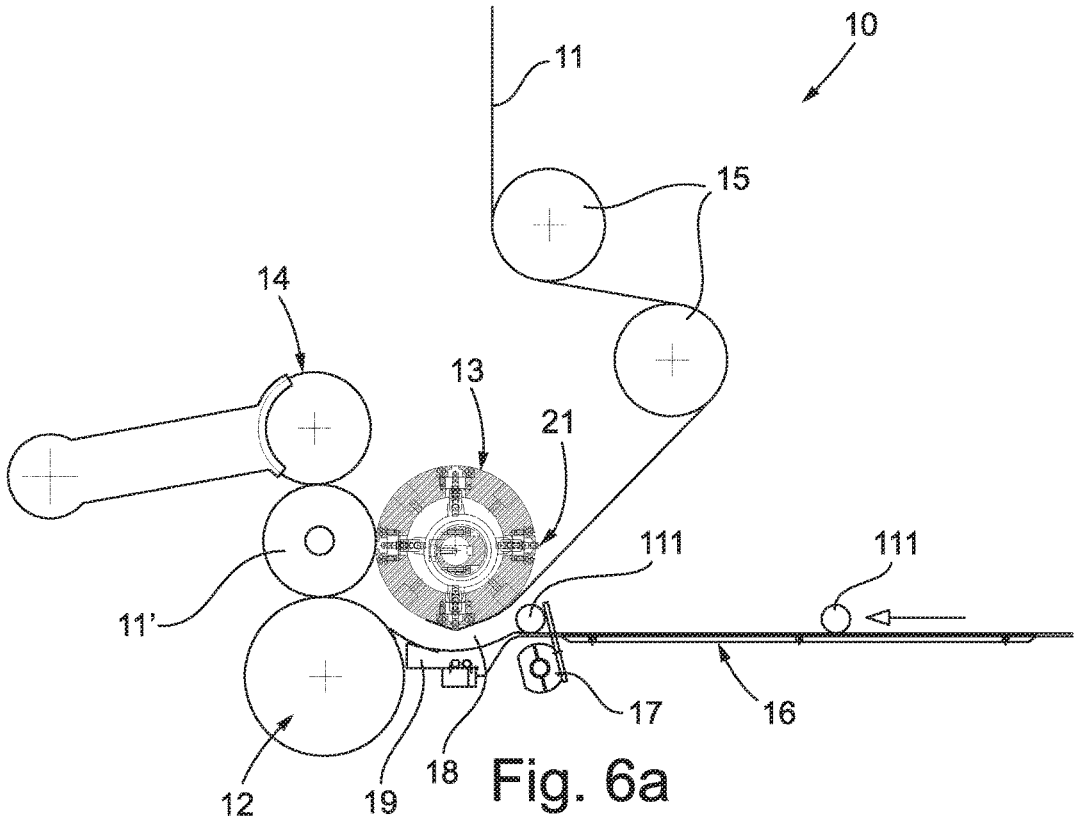
Figure 6B:
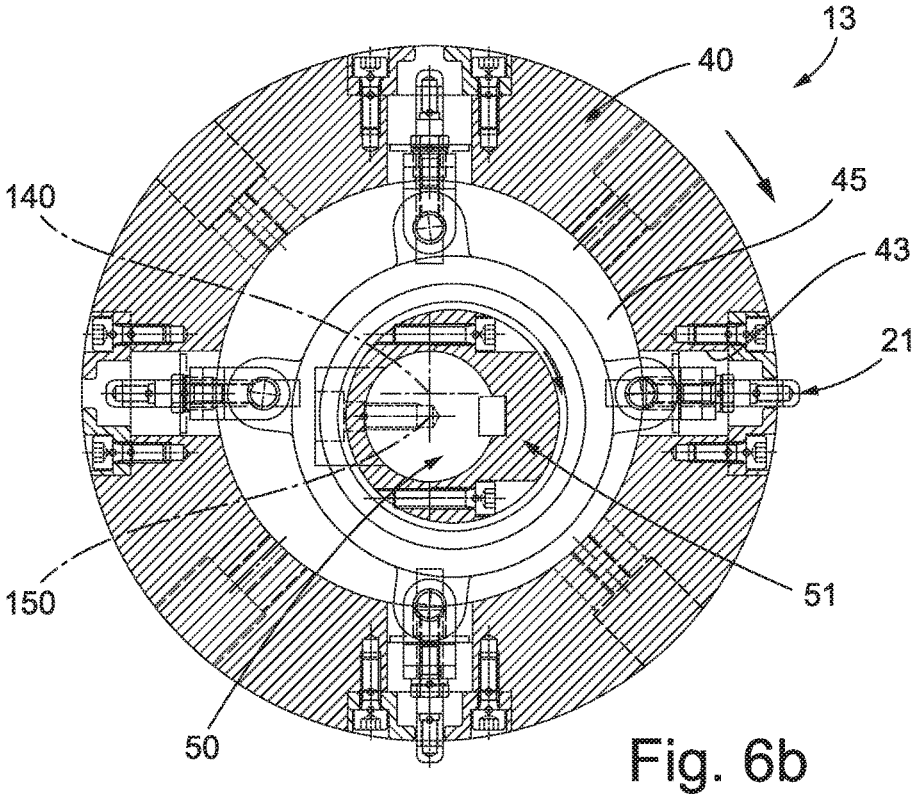
Figure 7A:
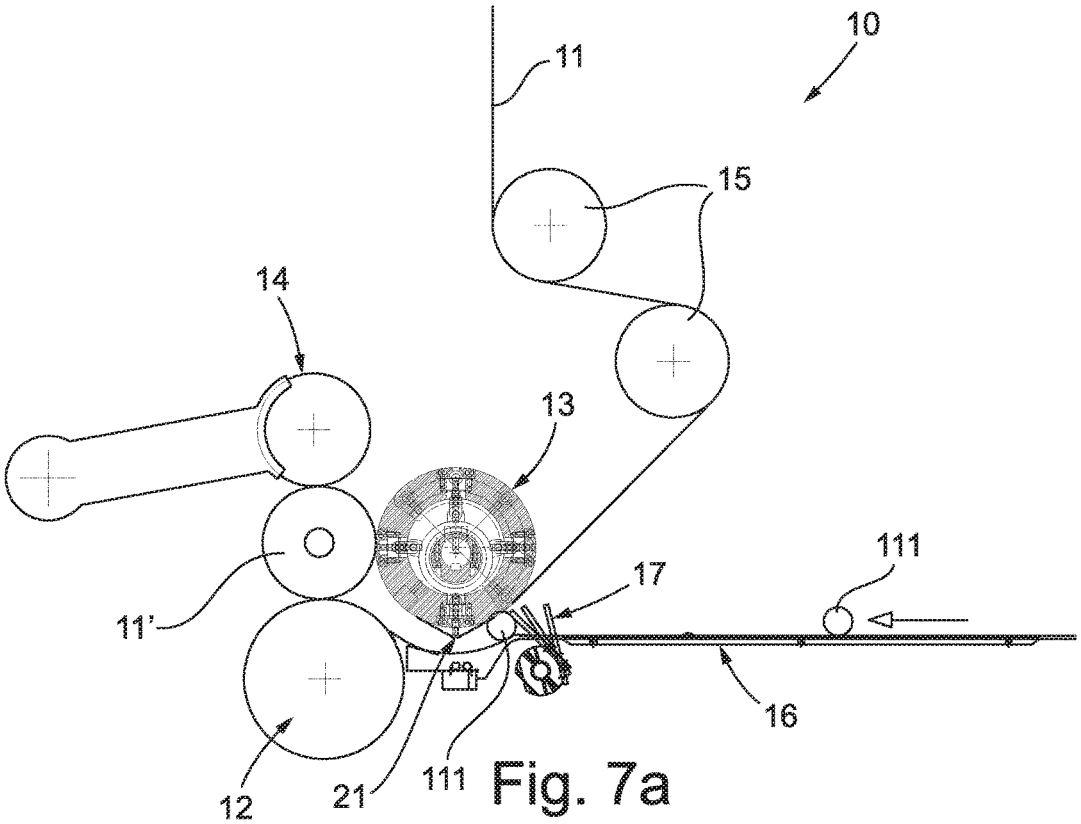
Figure 7B:
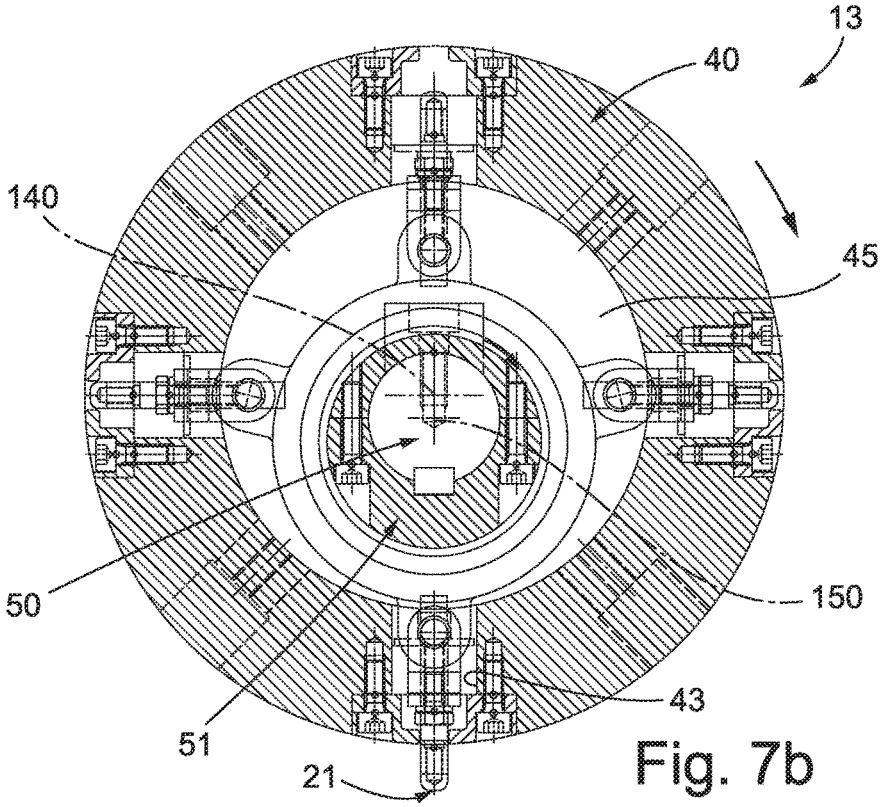

FIGS. 4*a* and 4*b* respectively show a device for rewinding and forming a paper roll according to the invention while winding the log at the beginning of the last 180° of winding with outer liner of the upper winding roller in rotation and inner eccentrics at the moment of start of the rotation, as well as the relevant enlarged detail in section of the upper winding roller with bars all inside the liner;

FIGS. 5*a* and 5*b* and 6*a* and 6*b* respectively show the device for rewinding and forming a paper roll during the last 180° of winding of the log with outer liner of the upper winding roller in rotation and inner eccentrics in rotation, as well as the relevant enlarged detail in section of the upper winding roller with two bars partially protruding from the liner;

FIGS. 7*a* and 7*b* respectively show the device for rewinding and forming a paper roll during the exchange step with outer liner of the upper winding roller in rotation and inner eccentrics in rotation, as well as the relevant enlarged detail in section of the upper winding roller with a bar fully protruding from the liner at six o'clock.

DETAILED DESCRIPTION

With reference to the figures, reference numeral 10 generally indicates a device for rewinding and forming a paper roll 11', called log, in a rewinding machine. The device 10 comprises three rollers with axes parallel to each other and perpendicular to the feeding direction of the paper 11, wherein two lower 12 and upper 13 winding rollers are supported during the winding of the roll 11' on the frame, i.e. on two opposite sides 100, and cooperate with a third swinging roller 14, called press, maintained during the winding pressing onto the roll 11' being formed.

The paper 11 being wound, provided with a series of transverse piercing and weakening lines, spaced according to regular intervals along its longitudinal development, is wound on the upper winding roller 13 so as to wrap the same with an inlet angle β with respect to six o'clock of roller 13, of about 45°. The paper 11, diverted by the return rollers 15 upstream of the upper winding roller 13, therefore wraps onto the upper winding roller 13 approximately tangent to the bisector of the second quadrant.

The finished roll 11', after the exchange step, exits from an output opening defined between the lower winding roller 12 and the third roller 14. By exchange step is meant the step in which the winding of a log 11' ends and a new winding begins.

The cores 111 are fed one by one by a conveyor 16 and inserted by a swinging pusher 17 within a channel 18 formed between the upper winding roller 13 and underlying curved elements 19, called cradles.

Mechanical tearing means are placed in the upper winding roller 13, along its development, to positively act on the paper 11 to cause the tearing of the paper 11 along a piercing line. Positively acting means acting with a thrust action directed outwards of the upper winding roller 13 on the paper 11 wrapped thereon, in particular directly at the predetermined piercing line for breaking so as to have a log 11' of the desired length. The tearing of the paper 11 takes place when the predetermined piercing line is facing the channel 18, in particular placed at six o'clock of the upper winding roller 13.

The upper winding roller 13 is made internally hollow and includes an outer liner 40 rotatably supported on sides 100 through hollow supports 40'.

The outer liner 40 is driven in rotation about an axis 140 by a motor 41 through a belt transmission 42, acting on the perimeter of the outer liner 40. The rotating motion of the outer liner 40 is responsible for driving the paper 11 and contributes to the winding of the log 11'.

The outer liner 40 contains in its inside a drive shaft 50 having a rotation axis 150 misaligned with respect to the rotation axis 140 of the liner 40. The drive shaft 50, on which a plurality of eccentrics 21 in phase with each other is keyed, is moved in rotation by a motor 52 set in axis, capable of exerting a torque of about 500-600 Nm.

Each eccentric 51 has a circular outer profile and is constrained to the drive shaft 50 in an offset position with respect to it, i.e. with its geometric centre not coinciding with the axle 150 of the drive shaft 50. The rotation of the drive shaft 50 is transferred to the eccentrics 51. During the rotation of the drive shaft 50, the eccentrics 51 take a position within the liner 40 that changes depending on their rotation angle.

According to a preferred embodiment shown by way of example, each eccentric 51 consists of two halves 51A and 51B joined by screws 53, and is constrained to the drive shaft 50 for example, via a keyed connection 54.

On the outer development of the liner 40, longitudinal seats 43 are formed for the mechanical tearing means, which housed into seats 43 are dragged in rotation integrally with the outer liner 40 itself.

The mechanical tearing means comprise at least three, preferably four, longitudinal bars 21 housed within the respective longitudinal seats 43 and distributed radially according to a constant angle α, equal to 120° or alternatively to 90°.

Each of the longitudinal bars 21 comprises two or more portions 21' arranged in series and moved in their radial translation movement synchronously with each other. Each portion 21' has a continuous outer surface in the longitudinal direction to not affect permanently the ply of paper 11.

The longitudinal seats 43 may be continuous in the direction of the cylindrical generatrix or interrupted in portions arranged in series, corresponding with the portions of the bars 21'.

The longitudinal seats 43 of the liner 40 have a plurality of through-openings 44 to access the inner cavity 45 of the liner 40, placed at the eccentrics 51 keyed onto the shaft 50, crossed by articulation means of the portions of longitudinal bars 21' to the eccentrics 51.

The articulation means comprise a joint 30 having a longitudinal axis, i.e. parallel to the axis of the shaft 50, and one or more radial bearings 31 applied between the eccentrics 51 and the joint 30 having a longitudinal axis.

The joint 30 having a longitudinal axis comprises a fork support 32, which is constrained at one end to the portion of the bar 21' by means of screws 33, preferably housed in a recess 34 formed in the portion of bar 21'. In this configuration, each portion 21' of the bar 21 has a continuous outer surface not interrupted by the presence of fixing screws.

The fork support 32 is provided at the opposite end with a through-hole, which houses a pin 35 constituting the axis of the joint. A flanged ring 36 is placed in engagement on each radial bearing 31 and engages with the pin 35 through sliding contacts 37, or bushings.

In the example, the outer perimeter of the flanged ring 36 has projections bearing the holes and a reduced radial encumbrance configuration between one hole and the other for geometrical encumbrance reasons with respect to the through-openings 44 of the outer liner 40.

By virtue of such articulation means, each of the bars 21 is selectively movable from a tearing position, or maximum projection with respect to the liner 40 at six o'clock of the upper roller 13, to a neutral position, or not projecting, and vice versa, when involved in the exchange step. When not involved in the exchange step, each bar 21 is passively movable between extracted, but not interfering with the paper, and retracted positions, with respect to the liner 40 determined by the eccentrics 51 which rotate to bring the selected bar 21 into the tearing position.

In order to guide the translation of the longitudinal bars 21, guide pins 22 are arranged along each portion 21' of bar, for example at opposite ends and possibly in a central position. The guide pins 22 are for example arranged integrally with the portions 21', slidable in translation into bushings 46 constrained to through-holes of the outer liner 40.

The translation of the bars 21 may also be guided by a cap 23 connected by screws 24 to the outer liner 40 in the proximity of the longitudinal seats to narrow the opening gap thereof to a width just greater than the width of the bars 21.

On the drive shaft 50, a plurality of bearings 55 is also applied to support the outer liner 40 at different points of its longitudinal development during the rotation. In the example shown, the bearings 55 consist of a plurality of rings coupled together and connected to the outer liner 40 through threaded connections 56, arranged radially at the bisectors between adjacent bars 21.

The outer liner 40, responsible for winding the paper 11, rotates continuously during the winding of the roll 11' at a constant speed that can be predetermined upon the start of the work cycle according to methods, object of the present invention, described hereinafter.

Eccentrics 51 instead have a pulse motion, as they carry out a rotation of 360° to determine the exit of a predetermined bar 21 during the exchange and to determine the return thereof into the liner 40 and then they stop until the next exchange step. The rotation of the eccentrics 51 takes place in a time of about 15 ms, which represents approximately 1% of the winding time of each log 11'.

When the eccentrics 51 are in the middle, i.e. they are positioned with their geometric centre on the axis 140 of the liner 40, all bars 21 are retracted into the liner 40. This position corresponds to the winding step of log 11'. As the exchange step approaches, the drive shaft 50 sets in rotation to bring the bar 21, which will be at six o'clock of the upper winding roller 13 at the piercing line to tear, in the tearing position, extracted equal to the maximum output distance, preferably of about 15 mm.

In the example shown, in which there are four bars 21 distributed along the liner 40 according to an angle $\alpha$ equal to 90°, the rotation of the drive shaft 50 is started when the bar 21 that will make the tear is at twelve o'clock. After a rotation of 180° of the shaft 50, the bar 21 comes out at six o'clock of the upper winding roller 13 by a distance equal to the maximum output distance. In the next 180° rotation of the drive shaft 50, the initial position is restored with all the bars 21 in retracted position and the eccentrics 51 with geometric centre on the axis of the liner 40.

The selection of the input angle $\beta$ of the paper 11 on the upper winding roller 13 and of the angular distribution of the bars 21 on the liner 40 is made in such a way as to prevent accidental contact of the exiting bar 21 with the paper 11, before reaching the tearing point at six o'clock of the upper winding roller 13.

Simultaneously with the maximum projection of the bar 21 at the piercing line of paper 11 at six o'clock on the upper winding roller 13, the insertion of the core 111 into the channel 18 is carried out in phase to cause the tensioning of the paper 11 in the section between the bar 21 and the insertion point of the core 111. Otherwise, a longer section of paper 11 would be tensioned, resulting in the absorption of the tension by the paper without tearing.

According to the invention, the paper 11 is torn during the exchange step upon reaching the predetermined winding length by a positive action of a longitudinal bar 21, moved in translation by a seat 43 on the mantle of the upper roller 13 outwards of the roller 13 itself, in which the bar 21 acts precisely along a piercing line positioned at six o'clock of the upper winding roller 13. The tearing of the paper 11 only occurs in these circumstances.

Without additional measures, the system would place stringent limits in relation to the distance between the piercing lines and the winding length which make it possible to match, for tearing the paper 11, a piercing line at six o'clock of the upper winding roller 13 with a longitudinal bar 21.

In order to carry out the tearing of the paper 11 along any piercing line and for the piercing lines to be placed at any predetermined fixed distance, according to the invention it is contemplated to adjust the speed of the upper winding roller 13 to bring one of the bars 21 at six o'clock of the upper winding roller 13 upon the passage of the piercing line to tear. In fact, the upper winding roller 13 can rotate at a different speed than the speed of the lower winding roller 12, i.e. of the feeding speed of the paper 11, lower or greater but constant, which can be set at the beginning of each working cycle based on the parameters of the roll 11' to be wound, such as distance between the piercings and winding length in addition to the geometry of the upper winding roller 13.

In order not to affect the winding of paper 11, the speed difference of the upper winding roller 13 must be contained, particularly within about +/−0.5% (1% total). Greater difference values between speeds would lead to excessive friction and the risk of accidental breakage. This is made possible by the presence of a number of longitudinal bars 21 equal to at least three, preferably four. A greater number of bars 21 would be advantageous in terms of reducing the speed difference required, but would involve an excessive encumbrance of the bars 21 and of their articulation means with respect to the size of the upper winding roller 13.

Knowing the distance between the piercing lines and the development of the upper winding roller 13, it is predictable if in the exchange step the piercing closer to six o'clock will be that upstream or downstream of six o'clock, to decide whether the upper roller 13 needs to be slowed down or speeded up in order to minimize the difference in speed to be imparted to the roller 13. With the same conditions of log to be wound, the difference in speed set for the upper winding roller 13 remains constant.

According to a particular operation case, it may not be necessary to phase the upper roller 13 if the piercings are multiple of the roller development.

According to an example in which the piercing lines are 110 mm away from each other and are present in a number equal to 150, the winding length is equal to 16500 mm. With an upper winding roller having a diameter of 210 mm, the roller development is equal to 659.71 mm. In 25 turns, the upper winding roller covers 16492 mm, i.e. 8 mm less than the winding length. The piercing line to break would then be 8 mm upstream with respect to six o'clock of the upper winding roller 13. The upper winding roller 13 should therefore be operated at a speed greater than the speed of the paper in order to distribute the 8 mm on the entire roll along 16500 mm, i.e. 0.001% speed difference.

The worst case is when the piercing line is halfway between two longitudinal bars 21, which in the example of roller 13 with a diameter of 210 mm and four bars 21, means 82 mm of gap, equivalent to 659.71 mm/8, which involves a speed difference of 0.01%.

In general, the worst case is also given by the total length of the log, meaning that the shorter the log, the more the problem is felt.

The method for rewinding and forming a paper roll according to the invention comprises the following steps:

setting a predetermined speed for the upper winding roller 13 of between +/−0.01 of the speed of the lower winding roller 12;

bringing a longitudinal bar 21 of a plurality of longitudinal bars 21 arranged radially distributed according to a constant angle α, at six o'clock of the upper winding roller 13 at the piercing line to be broken;

removing the longitudinal bar 21 at the piercing line placed six o'clock of the upper winding roller 13;

tearing the paper 11 along the piercing line.

The device for rewinding and forming a paper roll and the related method according to the present invention have the advantage of ensuring maximum flexibility of the roll 11' to be wound in terms of distance between the piercing lines and of winding length.

Advantageously, the speed difference between the upper winding roller and winding paper is kept contained.

Another advantage is the possibility to change the number of tears and the product length at the start of the production cycle.

The device for rewinding and forming a paper roll and the related method thus conceived are susceptible to numerous changes and variations, all falling within the invention; moreover, all details can be replaced with technically equivalent elements. In the practice, the materials used as well as the dimensions, may be any, according to technical requirements.

The invention claimed is:

1. A device for rewinding and forming a paper roll in a rewinding machine comprising three rollers (12, 13, 14) with axes parallel to each other and perpendicular to a paper feeding direction (11), wherein two lower and upper winding rollers (12, 13) supported on a frame (100) cooperate with a third swinging roller (14) pressing on a roll or log (11') being formed, a paper (11) being wound on the upper winding roller 13 is provided with a series of transverse piercing and weakening lines spaced according to regular intervals along its longitudinal development and a finished roll (11') exiting from an output opening defined between the lower roller (12) and the third roller (14), cores (111) for said rolls (11') being fed one after the other by a conveyor (16) and inserted by a pusher (17) within a channel (18) obtained below the upper roller (13), wherein mechanical tearing means are placed in the upper roller (13) along its development facing towards the side of the paper facing towards the upper winding roller (13) in order to positively act directly at a piercing line and to cause the tearing of the paper (11), wherein said mechanical tearing means comprise at least three longitudinal bars (21) housed in longitudinal seats (43) in the cylindrical shell of the upper winding roller (13) and radially distributed by a constant angle (α) along the development thereof, each of them being selectively movable from a tearing position, projecting with respect to the shell of the upper winding roller (13), to a neutral position, not projecting, and in that said upper winding roller (13) is provided with an independent motor (41) for setting the rotation speed independently of the feeding speed of the paper (11) and of the lower winding roller (12).

2. The device according to claim 1, wherein each of the longitudinal bars (21) comprises at least two portions (21'), wherein each portion (21') has an outer surface that is continuous in the longitudinal direction.

3. The device according to claim 1, wherein the upper winding roller (13) comprises a hollow liner (40), said independent motor (41) exerting the force through a belt (42) onto the shell of the liner (40).

4. The device according to claim 3, wherein the outer shell (40) contains in its inside a drive shaft (50) having a rotation axis (150) misaligned with respect to the rotation axis (140) of the liner (40), and a plurality of eccentrics (51) in phase with each other is constrained to the drive shaft (50).

5. The device according to claim 4, wherein said drive shaft (50) is moved in rotation by a motor (52) set in axis, capable of exerting a torque of 500-600 Nm.

6. The device according to claim 5, wherein said bar pieces (21) are connected to the eccentrics (51) by means of articulation means crossing the liner (40) by means of through-openings (44).

7. The device according to claim 6, wherein said articulation means comprise a joint (30) having a longitudinal axis which is parallel to the axis of the shaft (50), and one or more radial bearings (31) applied between the eccentrics (51) and the joint (30) having a longitudinal axis.

8. The device according to claim 1, wherein the device comprises guide pins (22) along said bars (21), said pins being arranged integrally with the bars (21) for sliding the bars (21) in translation to the outer liner (40) or in that the device comprises a cap (23) joined to the outer liner (40) close to the longitudinal seats (43) in order to narrow the opening gap thereof to a width greater than the length of the bars (21) for guiding the translation of the bars (21).

9. A method for rewinding and forming a paper roll, wound in a device according to claim 1, comprising the following steps:

setting a predetermined constant speed for the upper winding roller (13) greater or lower than the speed of the lower winding roller (12);

bringing a longitudinal bar (21) of the plurality of longitudinal bars (21), radially distributed according to a constant angle α, at six o'clock of the upper winding roller (13) at the piercing line to be broken;

extracting the longitudinal bar (21) from the upper winding roller (13) at the piercing line placed at six o'clock of the upper winding roller (13);

tearing the paper (11) at said piercing line.

10. The method according to claim 9, further comprising the step of rotating the drive shaft (50) by 360° at the exchange step, a longitudinal bar (21) exiting in tear-off position during the first 180° rotation and the bars (21) being all returned to a neutral position during the subsequent 180°.

* * * * *